US007261747B2

(12) United States Patent
Waynick

(10) Patent No.: US 7,261,747 B2
(45) **Date of Patent: *Aug. 28, 2007**

(54) REMOVAL OF DRAG REDUCER ADDITIVE FROM LIQUID HYDROCARBON FUEL USING ATTAPULGUS CLAY

(75) Inventor: John Andrew Waynick, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 619 days.

This patent is subject to a terminal disclaimer.

(21) Appl. No.: 10/795,889

(22) Filed: Mar. 8, 2004

(65) Prior Publication Data

US 2005/0193622 A1 Sep. 8, 2005

(51) Int. Cl.
*C10L 1/12* (2006.01)

(52) U.S. Cl. ..... 44/457; 44/459; 210/728; 585/820; 585/823

(58) Field of Classification Search ..... 44/457, 44/459; 210/728; 585/820, 823
See application file for complete search history.

(56) References Cited

U.S. PATENT DOCUMENTS

| | | | |
|---|---|---|---|
| 1,198,039 | A | 9/1916 | Krause |
| 2,546,903 | A | 3/1951 | Morrell |
| 2,744,938 | A | 5/1956 | Urban, Jr. |
| 2,762,852 | A | 9/1956 | Litton |
| 3,366,582 | A | 1/1968 | Adams et al. |
| 3,977,969 | A | 8/1976 | Zall |
| 4,451,377 | A | 5/1984 | Luxemburg |
| 4,502,957 | A | 3/1985 | Jehle et al. |
| 4,508,851 | A | 4/1985 | Izumi et al. |
| 4,527,581 | A | 7/1985 | Motier |
| 4,599,117 | A | 7/1986 | Luxemburg |
| 4,720,397 | A | 1/1988 | O'Mara et al. |
| 4,747,855 | A | 5/1988 | Hirai et al. |
| 4,758,354 | A | 7/1988 | O'Mara et al. |
| 4,837,249 | A | 6/1989 | O'Mara et al. |
| 5,165,440 | A | 11/1992 | Johnston |
| 5,225,081 | A | 7/1993 | Brownawell |
| 5,244,937 | A | 9/1993 | Lee et al. |
| 5,376,697 | A | 12/1994 | Johnston et al. |
| 5,449,732 | A | 9/1995 | Smith et al. |
| 5,504,132 | A | 4/1996 | Smith et al. |
| 5,539,044 | A | 7/1996 | Dindi et al. |
| 5,733,953 | A | 3/1998 | Fairchild et al. |
| 5,736,053 | A | 4/1998 | Ikushima et al. |
| 5,788,865 | A | 8/1998 | Smirnov et al. |
| 5,833,862 | A | 11/1998 | Holland |
| 5,884,777 | A | 3/1999 | Pan et al. |
| 5,888,402 | A | 3/1999 | Hommeltoft et al. |
| 5,891,324 | A | 4/1999 | Ohtsuka |
| 5,893,398 | A | 4/1999 | Garrett, Jr. |
| 5,900,153 | A | 5/1999 | Sanford |
| 6,024,880 | A | 2/2000 | Ciora, Jr. et al. |
| 6,027,653 | A | 2/2000 | Holland |
| 6,042,722 | A | 3/2000 | Lenz |
| 6,056,805 | A | 5/2000 | Litwin et al. |
| 6,082,392 | A | 7/2000 | Watkins, Jr. |
| 6,103,127 | A | 8/2000 | Pourfarzaneh |
| 6,599,337 | B2 * | 7/2003 | Waynick ..... 44/903 |
| 7,018,434 | B2 | 3/2006 | Waynick |
| 2003/0019149 | A1 | 1/2003 | Waynick |
| 2004/0015034 | A1 | 1/2004 | Waynick |
| 2004/0244280 | A1 | 12/2004 | Waynick |
| 2004/0249233 | A1 | 12/2004 | Waynick |

FOREIGN PATENT DOCUMENTS

| | | |
|---|---|---|
| GB | 1236066 | 6/1971 |
| WO | WO 02/086030 A1 | 10/2002 |
| WO | WO 2004/108862 A1 | 12/2004 |
| WO | WO 2005/086803 A2 | 9/2005 |
| WO | WO 2005/087902 A1 | 9/2005 |

OTHER PUBLICATIONS

The International Bureau of WIPO, International Preliminary Report on Patentability, PCT/US2005/007545, Sep. 21, 2006, 5 pgs.
U.S. Commissioner of Patents and Trademarks, International Preliminary Examination Report, PCT/US02/12302, Mar. 10, 2003, 4 pgs.

(Continued)

*Primary Examiner*—Cephia D. Toomer
(74) *Attorney, Agent, or Firm*—The Morris Law Firm, P.C.

(57) ABSTRACT

The present application provides a method for removing drag reducer additive ("DRA") from liquid hydrocarbon fuel. The method comprises: providing contaminated liquid hydrocarbon fuel comprising an initial concentration of DRA; contacting the contaminated liquid hydrocarbon fuel with a quantity of fresh attapulgus clay under conditions effective to produce decontaminated liquid hydrocarbon fuel comprising a reduced concentration of the DRA; said fresh attapulgus clay being effective to remove about 10% or more of a target DRA when 1 g of the fresh attapulgus clay is added in increments of from about 0.02 gram to about 0.1 gram, with agitation, to 100 ml. of contaminated liquid hydrocarbon fuel comprising from about 8 to about 9 ppm of the unsheared target DRA.

67 Claims, No Drawings

OTHER PUBLICATIONS

U.S. Commissioner of Patents and Trademarks, International Search Report and Written Opinion, PCT/US05/07572, Sep. 29, 2006, 6 pgs.

U.S. Commissioner of Patents and Trademarks, International Search Report and Written Opinion, PCT/US05/07542, Oct. 2, 2006, 6 pgs.

Natalie Marchildon, et al. The AA Graphite Deposit, Bella Coola Area, British Columbia: Exploration Implications For The Coast Plutonic Complex. (92M/15) Geological Fieldwork 1992, Paper 1993-1 p. 389-397. http://www.em.gov.bc.ca/DL/GSBPubs/GeoFldWk/1992/389-398-marchildon.pdf.

Edward Matulevicius. Fuel Technology Associates. Effect of Pipeline Drag Reducer Additive on Coalescence & Filtration in Aviation Fuels. A Plan for Determining the Effect of Fully Sheard pipeline Drag Reducer Additives on Filter/Separators and Monitors. Apr. 9, 2001 http://www.crcao.com/aviation/Presentation%202001 CRC%20Final%20PDR%20Plan.pdf.

* cited by examiner

REMOVAL OF DRAG REDUCER ADDITIVE FROM LIQUID HYDROCARBON FUEL USING ATTAPULGUS CLAY

CROSS-REFERENCE TO RELATED APPLICATIONS

The present application relates to U.S. patent application Ser. No. 10/453,803, filed Jun. 3, 2003, published as US-2004-0015034-A1 on Jan. 22, 2004, pending. The present application also relates to U.S. Pat. No. 6,599,337, issued Jul. 29, 2003. Each of the foregoing references is incorporated herein by reference.

FIELD OF THE INVENTION

The application relates to a method for removing drag reducer additive ("DRA") from liquid hydrocarbon fuel using fresh attapulgus clay.

BACKGROUND

DRA typically is added to flowing fluids in order to reduce the energy lost due to friction, or drag, thus permitting the movement of more fluid at the same differential pressure. The resulting reduction in frictional pressure drop improves pumping efficiency, lowers energy costs, and increases profitability.

Unfortunately, whether in the virgin form or in the sheared or partially sheared form, and despite the fact that it is intentionally added to certain fuels, drag reducer additive still is a "contaminant" in liquid hydrocarbon fuels, and has the potential to cause a number of problems. Drag reducer additive is prohibited in aviation turbine fuels, although it has been observed as a contaminant due to accidental addition or other non-intentional means. The presence of drag reducer additive in aviation turbine fuel may result in downgrading of the entire batch to non-aviation kerosene or diesel fuel, both of which generally have less market value.

Viable methods of detecting and quantifying drag reducer additive in liquid hydrocarbon fuels commonly employ gel permeation chromatography, which is time consuming and expensive. Because of this, contaminated liquid hydrocarbon fuels often are used, despite the potential problems if drag reducer additive is present. Contaminated aviation turbine fuels may be diverted to other uses or returned to a refinery for reprocessing, either of which results in additional expense.

Simple and inexpensive methods and materials are needed for removing drag reducer additive from liquid hydrocarbon fuels.

SUMMARY

The present application provides a method for removing drag reducer additive ("DRA") from liquid hydrocarbon fuel. The method comprises: providing contaminated liquid hydrocarbon fuel comprising an initial concentration of DRA; contacting the contaminated liquid hydrocarbon fuel with a quantity of fresh attapulgus clay under conditions effective to produce decontaminated liquid hydrocarbon fuel comprising a reduced concentration of the DRA; said fresh attapulgus clay being effective to remove about 10% or more of a target DRA when 1 g of the fresh attapulgus clay is added, with agitation, in increments of from about 0.02 gram to about 0.1 gram to 100 ml. of contaminated liquid hydrocarbon fuel comprising from about 8 to about 9 ppm of the unsheared target DRA.

DETAILED DESCRIPTION

The presence of DRA in motor gasoline, even in sheared form, has caused increased intake valve deposits, plugging of fuel filters, and increased combustion chamber deposits. In jet engines, use of aviation jet fuel containing even sheared DRA has been shown to adversely affect the ability of the jet engines to reignite if a flameout occurs. In diesel fuels, DRA may cause plugging of fuel filters and strainers and/or increased fuel injector deposits. DRA is prohibited in aviation turbine fuels, although DRA has been observed as a contaminant due to accidental addition or other non-intentional means. The presence of DRA in aviation turbine fuel may result in downgrading of the entire batch to non-aviation kerosene or diesel fuel, both of which generally have less market value.

Attapulgus clay is used to remove polar contaminants from fuels, such as aviation fuels. Most DRA is relatively non-polar, and known systems comprising attapulgus clay have not demonstrated an ability to remove DRA from fuels.

Surprisingly, it has been found that "fresh" attapulgus clay does remove DRA from liquid hydrocarbon fuel.

"Fresh" attapulgus clay is defined as attapulgus clay which is effective to remove about 10% or more of a target DRA when 1 g of attapulgus clay is added in increments of from about 0.02 gram to about 0.1 gram, with agitation, to 100 ml. of contaminated liquid hydrocarbon fuel comprising from about 8 to about 9 ppm of the unsheared target DRA. In a preferred embodiment, the fresh attapulgus clay is effective to remove about 20% or more of a target DRA when 1 g of attapulgus clay is added in increments of from about 0.02 gram to about 0.1 gram, with agitation, to 100 ml. of a contaminated liquid hydrocarbon fuel comprising from about 8 to about 9 ppm of the unsheared target DRA.

Without limiting the application to a particular mechanism of action, the polar contaminants in liquid hydrocarbon fuels, particularly aviation fuel, are believed to selectively adhere to active sites on attapulgus clay in preference to DRA, which typically is relatively non-polar. As used herein, the phrase "used attapulgus clay" refers to clay having active sites which are unavailable to bind DRA to the same extent as fresh attapulgus clay. Typically, "used attapulgus clay" has been exposed to liquid hydrocarbon fuel comprising contaminants which have a stronger attraction to the active sites of attapulgus clay than DRA.

Attapulgus clay is believed to comprise grains of fine sand, each of which is made up of even smaller particles that cling together to form a porous mass. These even smaller particles contain complex multicentered crystalline structures of oxides and hydroxides of magnesium, aluminum and silicon. Attapulgus clay generally comprises about 90 wt. % or more Fuller's earth and about 10 wt. % or less silica crystalline (Quartz). The attapulgus clay generally comprises granules comprising a conglomerate of fundamental particles. A majority of the granules typically have a mesh size of from about 30 to about 90.

"Liquid Hydrocarbon Fuel"

By "liquid hydrocarbon fuel" is meant any hydrocarbon that is liquid under conditions of transport and/or storage. Suitable liquid hydrocarbon fuels include, but are not necessarily limited to those having a boiling range of from about 150° F. to about 750° F., which may be used as a fuel. In one embodiment, the liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, or bunker fuel. In a preferred embodiment, the liquid hydrocarbon fuel is selected from the group consisting of diesel fuel, jet fuel, aviation gasoline, and motor gasoline. In a more preferred embodiment, the liquid hydrocarbon fuel is jet fuel, at least in part due to the stringent requirements applicable to jet fuel and drag reducer additive. The phrase "jet fuel" refers to both commercial jet fuel (Jet A, Jet A-1, and JET B) and military jet fuel, such as JP-4, JP-5, JP-8 and the like. "Contaminated liquid hydrocarbon fuel" refers to fuel comprising DRA.

"DRA"

DRA includes, but is not necessarily limited to polyolefin polymers comprising polyolefin moieties which are introduced into petroleum liquids for the purpose of reducing fluid flow drag. In a preferred embodiment, the drag reducer additive includes, but is not necessarily limited to, non-polar long-chain polyolefin polymers, generally referred to as "polyalphaolefins," having a "peak" molecular weight sufficiently high to allow the polymers to reduce fluid flow drag. Suitable polyalphaolefins are believed to have a molecular weight of about 1 million Daltons or more, more preferably about 10 million Daltons or more, most preferably about 25 million Daltons or more. The "peak" molecular weight refers to the peak that typically is measured as the drag reducer is eluted and detected during gel permeation chromatography.

Suitable polyalphaolefins comprise polymerized linear alpha olefin (LAO) monomers having from about 2 to about 40 carbon atoms, preferably from about 2 to about 30 carbon atoms, more preferably from about 4 to about 20 carbon atoms, most preferably from about 6 to about 12 carbon atoms. An especially preferred embodiment for a DRA which is effectively removable by the activated carbons and/or graphites described herein comprises two different LAO's or more, preferably having from about 6 to about 12 carbon atoms, the number of carbon atoms of the two different LAO's differing by 6.

Polyalphaolefins having relatively high molecular weights are required to impart good drag reduction. Suitable polyalphaolefins "are made by a variety of processes, including but not necessarily limited to solution polymerization and bulk polymerization. Bulk polymerization is said to produce "ultra-high molecular weight polyolefin drag reducers [that] are significantly larger (molecular weight basis) than the best molecular weights made by solution polymerization." See U.S. Pat. No. 5,504,132. Preferred DRA's for removal according to the process described herein are made by solution polymerization.

Without limiting the invention to a specific theory or mechanism of action, the very large polyalphaolefins made by bulk polymerization may be more difficult to adsorb onto and retain on the fresh attapulgus clay. In contrast, the polyalphaolefins made by solution polymerization may be more readily adsorbable onto the fresh attapulgus clay, and more readily retained by the removal agents.

Drag reducer additives are generally unsheared, partially sheared, or fully sheared. An additive that is fully sheared is one that is degraded in molecular weight to the maximum extent possible using high shear devices such as pumps, static mixers, etc. Commercially available drag reducer additives include, but are not necessarily limited to, CDR® Flow Improver REFINED POWER™, and REFINED POWER II™ manufactured by ConocoPhillips; EN-660 Flow Improver, manufactured by Energy 2000 LLC; and, FLO®XS and FLO®XL, manufactured by Baker Petrolite. In a preferred embodiment, the drag reducer additive is FLO®XS and equivalents thereof.

In another embodiment, the DRA comprises polar groups. Examples of suitable polar groups include, but are not necessarily limited to polar organic groups. Suitable polar groups generally comprise a moiety selected from the group consisting of oxygen, sulfur, nitrogen, halogen, phosphorus, unsaturated carbon-carbon bonds, and combinations thereof.

The DRA may comprise other components besides the polyolefin moieties. Examples of such components include, but are not necessarily limited to surfactant, catalyst residue, other additives, and other byproducts from the production of the polymer. The polymer itself may contain other non-olefin monomer units as well.

When it is desired to remove DRA from a given fuel, one or more attapulgus clay preferably is incorporated into a system for filtering the contaminated liquid hydrocarbon fuel. The filter may be in any suitable form and may be installed in a variety of locations.

Suitable locations for the filter system comprising the DRA removal agent include, but are not necessarily limited to: at a refinery; between a refinery and a fuel terminal; at a fuel terminal; between two different fuel terminals; between a fuel terminal and a airport storage tank; at an airport storage tank; between a fuel terminal and a tanker truck; at a tanker truck; between an airport storage tank and a tanker truck; between two different tanker trucks; between a tanker truck and an engine, at a fuel dispenser (such as a gasoline pump); between a fuel dispenser and a vehicle comprising the engine; and, at the engine.

Before contact with the contaminated liquid hydrocarbon fuel, the fresh attapulgus clay preferably is preheated to a temperature effective to remove adsorbed water (if any) without damaging the fresh attapulgus clay.

Due to the difficulty in providing for incremental addition and agitation in most commercial situations, it may be preferred to simply pass the liquid hydrocarbon fuel through a bed comprising the fresh attapulgus clay until the removal rate is so low that the resulting "used" attapulgus clay must be replaced. In one embodiment, the filtering system provides for agitation of the DRA/fuel mixture as incremental additions of fresh attapulgus clay are added to the DRA/fuel mixture. This procedure is sometimes herein referred to as the "gradual addition and stirring" method or "Grad Add/Stir" method. This is a preferred method for more viscous hydrocarbon fuels such as jet fuel.

The application will be better understood with reference to the following examples, which are illustrative only:

EXAMPLE 1

The Grad Add/Stir method was used in this example. About 100 ml of jet fuel comprising about 8.36 ppm of sheared FLO® XS (manufactured by Baker Petrolite, sheared by mechanical agitation prior to its addition to the jet fuel) was stirred with a magnetic stir bar, to create a moderate vortex. Increments of about 0.02 to about 0.1 gram of fresh attapulgus clay obtained from Forcoven Products, Humble, Tex., were placed in the agitating DRA/j et fuel mixture, while stirring, until a total of about 1.0 g of the fresh attapulgus clay had been added. The stirring was continued for approximately two to three minutes. The sample was allowed to settle for about 5 minutes. The fuller's earth and silica crystalline were removed from the mixture by filtration with a Whatman 8 micron filter. The mixture was then tested for DRA concentration. Over 20%

DRA removal was achieved by exposure of the DRA/jet fuel mixture to the fresh attapulgus clay.

Persons of ordinary skill in the art will recognize that many modifications may be made to the present application without departing from the spirit and scope of the present application. The embodiment described herein is meant to be illustrative only and should not be taken as limiting the application.

I claim:

1. A method for removing drag reducer additive ("DRA") from liquid hydrocarbon fuel, said method comprising:

providing contaminated liquid hydrocarbon fuel comprising an initial concentration of DRA;

contacting said contaminated liquid hydrocarbon fuel with a quantity of fresh attapulgus clay under conditions effective to produce decontaminated liquid hydrocarbon fuel comprising a reduced concentration of said DRA;

said fresh attapulgus clay being effective to remove about 10% or more of a target DRA when 1 g of the fresh attapulgus clay is added in increments of from about 0.02 gram to about 0.1 gram, with agitation, to 100 ml. of contaminated liquid hydrocarbon fuel comprising from about 8 to about 9 ppm of unsheared target DRA.

2. The method of claim 1 wherein said conditions effective to produce decontaminated liquid hydrocarbon fuel comprise incremental addition of the fresh attapulgus clay and agitation of the resulting mixture.

3. The method of claim 1 wherein said conditions effective to produce decontaminated liquid hydrocarbon fuel comprise passing the contaminated liquid hydrocarbon fuel through a bed comprising said fresh attapulgus clay.

4. The method of claim 3 wherein said contacting produces used attapulgus clay, said method further comprising replacing said used attapulgus clay with fresh attapulgus clay.

5. The method of claim 1 wherein said contacting said contaminated liquid hydrocarbon fuel comprising an initial concentration of DRA with fresh attapulgus clay occurs at a location selected from the group consisting of: at a refinery; between a refinery and a fuel terminal; at a fuel terminal; between two different fuel terminals; between a fuel terminal and a airport storage tank; at an airport storage tank; between a fuel terminal and a tanker truck; at a tanker truck; between an airport storage tank and a tanker truck; between two different tanker trucks; between a tanker truck and an engine, at a fuel dispenser; between a fuel dispenser and a vehicle comprising the engine; and, at the engine.

6. The method of claim 1 further comprising preheating said fresh attapulgus clay prior to use under conditions effective to remove adsorbed water without damaging said fresh attapulgus clay.

7. The method of claim 1 wherein said reduced concentration of DRA is sufficiently low to perform one or more function selected from the group consisting of permitting reignition of jet fuel after flameout, decreasing plugging of fuel filters and reducing formation of deposits on engine components selected from the group consisting of intake valves, combustion chambers, and fuel injectors.

8. The method of claim 1 wherein said liquid hydrocarbon fuel has a boiling range of from about 150° F. to about 750° F.

9. The method of claim 1 wherein said liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, and bunker fuel.

10. The method of claim 1 wherein said liquid hydrocarbon fuel is selected from the group consisting of diesel fuel, jet fuel, aviation gasoline, and motor gasoline.

11. The method of claim 1 wherein said liquid hydrocarbon fuel is jet fuel.

12. The method of claim 1 wherein said reduced concentration of DRA is sufficiently low to permit reignition of said jet fuel after flameout.

13. The method of claim 1 wherein said drag reducer additive comprises polyalphaolefin having a peak molecular weight of about 1 million Daltons or more.

14. The method of claim 12 wherein said drag reducer additive comprises polyalphaolefin having a peak molecular weight of about 1 million Daltons or more.

15. The method of claim 1 wherein said drag reducer additive comprises polyalphaolefin having a peak molecular weight of about 10 million Daltons or more.

16. The method of claim 12 wherein said drag reducer additive comprises polyalphaolefin having a peak molecular weight of about 10 million Daltons or more.

17. The method of claim 12 wherein said drag reducer additive comprises polyalphaolefin having a peak molecular weight of about 25 million Daltons or more.

18. The method of claim 13 wherein said polyalphaolefin is made by solution polymerization.

19. The method of claim 14 wherein said polyalphaolefin is made by solution polymerization.

20. The method of claim 1 wherein said DRA comprises two different linear alpha olefins (LAO's) or more having from about 6 to about 12 carbon atoms, the number of carbon atoms of the two different LAO's differing by 6.

21. The method of claim 1 wherein said DRA comprises polar groups.

22. The method of claim 21 wherein said polar groups comprise organic polar groups.

23. The method of claim 21 wherein said polar groups comprise a moiety selected from the group consisting of oxygen, sulfur, nitrogen, halogen, phosphorus, unsaturated carbon-carbon bonds, and combinations thereof.

24. A method for removing DRA from liquid hydrocarbon fuel, said method comprising:

providing contaminated liquid hydrocarbon fuel comprising an initial concentration of DRA;

contacting said contaminated liquid hydrocarbon fuel with a quantity of fresh attapulgus clay under conditions effective to produce decontaminated liquid hydrocarbon fuel comprising a reduced concentration of said DRA;

said fresh attapulgus clay being effective to remove about 20% or more of a target DRA when 1 g of the fresh attapulgus clay is added in increments of from about 0.02 gram to about 0.1 gram, with agitation, to 100 ml. of contaminated liquid hydrocarbon fuel comprising from about 8 to about 9 ppm of unsheared target DRA.

25. The method of claim 24 wherein the fresh attapulgus clay comprises granules, a majority of the granules having a mesh size of from about 30 to about 90.

26. The method of claim 24 wherein said conditions effective to produce decontaminated liquid hydrocarbon fuel comprise incremental addition of the fresh attapulgus clay and agitation of the resulting mixture.

27. The method of claim 26 wherein said conditions effective to produce decontaminated liquid hydrocarbon fuel comprise incremental addition of the fresh attapulgus clay and agitation of the resulting mixture.

28. The method of claim 25 wherein said contacting said contaminated liquid hydrocarbon fuel comprising an initial concentration of DRA with fresh attapulgus clay occurs at a location selected from the group consisting of: at a refinery; between a refinery and a fuel terminal; at a fuel terminal; between two different fuel terminals; between a fuel terminal and a airport storage tank; at an airport storage tank; between a fuel terminal and a tanker truck; at a tanker truck; between an airport storage tank and a tanker truck; between two different tanker trucks; between a tanker truck and an engine, at a fuel dispenser; between a fuel dispenser and a vehicle comprising the engine; and, at the engine.

29. The method of claim 24 further comprising preheating said fresh attapulgus clay prior to use under conditions effective to remove adsorbed water without damaging the fresh attapulgus clay.

30. The method of claim 24 wherein said reduced concentration of DRA is sufficiently low to perform one or more function selected from the group consisting of permitting reignition of jet fuel after flameout, decreasing plugging of fuel filters and reducing formation of deposits on engine components selected from the group consisting of intake valves, combustion chambers, and fuel injectors.

31. The method of claim 24 wherein said liquid hydrocarbon fuel has a boiling range of from about 150° F. to about 750° F.

32. The method of claim 24 wherein said liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, and bunker fuel.

33. The method of claim 24 wherein said liquid hydrocarbon fuel is selected from the group consisting of diesel fuel, jet fuel, aviation gasoline, and motor gasoline.

34. The method of claim 24 wherein said liquid hydrocarbon fuel is jet fuel.

35. The method of claim 34 wherein said reduced concentration of DRA is sufficiently low to permit reignition of said jet fuel after flameout.

36. The method of claim 24 wherein said drag reducer additive comprises polyalphaolefin having a peak molecular weight of about 1 million Daltons or more.

37. The method of claim 35 wherein said drag reducer additive comprises polyalphaolefin having a peak molecular weight of about 1 million Daltons or more.

38. The method of claim 24 wherein said drag reducer additive comprises polyalphaolefin having a peak molecular weight of about 10 million Daltons or more.

39. The method of claim 35 wherein said drag reducer additive comprises polyalphaolefin having a peak molecular weight of about 10 million Daltons or more.

40. The method of claim 35 wherein said drag reducer additive comprises polyalphaolefin having a peak molecular weight of about 25 million Daltons or more.

41. The method of claim 36 wherein said polyalphaolefin is made by solution polymerization.

42. The method of claim 37 wherein said polyalphaolefin is made by solution polymerization.

43. The method of claim 24 wherein said DRA comprises two different linear alpha olefins (LAO's) or more having from about 6 to about 12 carbon atoms, the number of carbon atoms of the two different LAO's differing by 6.

44. The method of claim 34 wherein said DRA comprises two different linear alpha olefins (LAO's) or more having from about 6 to about 12 carbon atoms, the number of carbon atoms of the two different LAO's differing by 6.

45. The method of claim 24 wherein said DRA comprises polar groups.

46. The method of claim 45 wherein said polar groups comprise organic polar groups.

47. The method of claim 45 wherein said polar groups comprise a moiety selected from the group consisting of oxygen, sulfur, nitrogen, halogen, phosphorus, unsaturated carbon-carbon bonds, and combinations thereof.

48. A method for removing DRA from liquid hydrocarbon fuel, said method comprising:

providing contaminated liquid hydrocarbon fuel comprising an initial concentration of DRA;

contacting said contaminated liquid hydrocarbon fuel with a bed comprising a quantity of fresh attapulgus clay under conditions effective to produce decontaminated liquid hydrocarbon fuel comprising a reduced concentration of said DRA;

said fresh attapulgus clay being effective to remove about 20% or more of a target DRA when 1 g of the fresh attapulgus clay is added in increments of from about 0.02 gram to about 0.1 gram, with agitation, to 100 ml of contaminated liquid hydrocarbon fuel comprising from about 8 to about 9 ppm of unsheared target DRA.

49. The method of claim 48 wherein said contacting produces used attapulgus clay, said method further comprising replacing said used attapulgus with said fresh attapulgus clay.

50. The method of claim 48 wherein said reduced concentration of DRA is sufficiently low to perform one or more function selected from the group consisting of permitting reignition of jet fuel after flameout, decreasing plugging of fuel filters and reducing formation of deposits on engine components selected from the group consisting of intake valves, combustion chambers, and fuel injectors.

51. The method of claim 48 wherein said liquid hydrocarbon fuel has a boiling range of from about 150° F. to about 750° F.

52. The method of claim 48 wherein said liquid hydrocarbon fuel is selected from the group consisting of liquefied natural gas (LNG), liquefied petroleum gas (LPG), motor gasoline, aviation gasoline, distillate fuels such as diesel fuel and home beating oil, kerosene, jet fuel, No. 2 oil, residual fuel, No. 6 fuel, and bunker fuel.

53. The method of claim 48 wherein said liquid hydrocarbon fuel is selected from the group consisting of diesel fuel, jet fuel, aviation gasoline, and motor gasoline.

54. The method of claim 48 wherein said liquid hydrocarbon fuel is jet fuel.

55. The method of claim 54 wherein said reduced concentration of DRA is sufficiently low to permit reignition of said jet fuel after flameout.

56. The method of claim 48 wherein said drag reducer additive comprises a polyalphaolefin having a peak molecular weight of about 1 million Daltons or more.

57. The method of claim 54 wherein said drag reducer additive comprises a polyalphaolefin having a peak molecular weight of about 1 million Daltons or more.

58. The method of claim 48 wherein said drag reducer additive comprises polyalphaolefin having a peak molecular weight of about 10 million Daltons or more.

59. The method of claim 55 wherein said drag reducer additive comprises polyalphaolefin having a peak molecular weight of about 10 million Daltons or more.

60. The method of claim 55 wherein said drag reducer additive comprises polyalphaolefin having a peak molecular weight of about 25 million Daltons or more.

61. The method of claim 57 wherein said polyalphaolefin is made by solution polymerization.

62. The method of claim 58 wherein said polyalphaolefin is made by solution polymerization.

63. The method of claim 48 wherein said DRA comprises two different linear alpha olefins (LAO's) or more having from about 6 to about 12 carbon atoms, the number of carbon atoms of the two different LAO's differing by 6.

64. The method of claim 55 wherein said DRA comprises two different linear alpha olefins (LAO's) or more having from about 6 to about 12 carbon atoms, the number of carbon atoms of the two different LAO's differing by 6.

65. The method of claim 48 wherein said DRA comprises polar groups.

66. The method of claim 48 wherein said polar groups comprise organic polar groups.

67. The method of claim 65 wherein said polar groups comprise a moiety selected from the group consisting of oxygen, sulfur, nitrogen, halogen, phosphorus, unsaturated carbon-carbon bonds, and combinations thereof.

* * * * *